US009605679B2

(12) United States Patent
Fath et al.

(10) Patent No.: US 9,605,679 B2
(45) Date of Patent: Mar. 28, 2017

(54) IMMERSION PUMP AND METHOD FOR ASSEMBLING AN IMMERSION PUMP

(75) Inventors: Michael Fath, Ludwigshafen (DE); Christoph Jaeger, Gerolsheim (DE); Boris Werner, Ludwigshafen (DE)

(73) Assignee: KSB Aktiengesellschaft, Frankenthal (DE)

( * ) Notice: Subject to any disclaimer, the term of this patent is extended or adjusted under 35 U.S.C. 154(b) by 171 days.

(21) Appl. No.: 14/126,780

(22) PCT Filed: May 30, 2012

(86) PCT No.: PCT/EP2012/060096

§ 371 (c)(1),
(2), (4) Date: Dec. 16, 2013

(87) PCT Pub. No.: WO2012/171792

PCT Pub. Date: Dec. 20, 2012

(65) Prior Publication Data

US 2014/0134013 A1 May 15, 2014

(30) Foreign Application Priority Data

Jun. 17, 2011 (DE) ..... 10 2011 077 777

(51) Int. Cl.
*F04D 29/60* (2006.01)
*F04C 13/00* (2006.01)
(Continued)

(52) U.S. Cl.
CPC ..... *F04D 13/08* (2013.01); *F04C 2/1071* (2013.01); *F04C 2/16* (2013.01); *F04C 13/008* (2013.01);
(Continued)

(58) Field of Classification Search
CPC .. F04C 2/008; F04C 2/16; F04D 13/08; F04D 13/086; F04D 13/10; F04D 29/606;
(Continued)

(56) References Cited

U.S. PATENT DOCUMENTS 4,015,633 A 4/1977 Mandell
4,298,065 A * 11/1981 Baski ..... E21B 33/00 166/115
(Continued)

FOREIGN PATENT DOCUMENTS

CN 2251063 Y 4/1997
DE 28 20 870 A1 11/1978
(Continued)

OTHER PUBLICATIONS

International Preliminary Report on Patentability, including translation of Written Opinion dated Dec. 17, 2013 (six (6) pages).
(Continued)

*Primary Examiner* — Devon Kramer
*Assistant Examiner* — Connor Tremarche
(74) *Attorney, Agent, or Firm* — Crowell & Moring LLP

(57) ABSTRACT

An immersion pump is provided, the pump having an integral housing with an inlet opening on an intake side, an outlet opening on a delivery side, a passage for electrical lines, an electronic unit for processing power and optionally information signals, an electric motor, a pressure chamber and a pump unit. The electronic unit, the electric motor, the pressure chamber and the pump unit may be pre-assembled to an insert, with the pre-assembled insert being supported on one end of the housing. An axial clamping and/or fastening system, in particular a tapered locking arrangement, is provided on the opposite end of the housing.

12 Claims, 3 Drawing Sheets

(51) Int. Cl.

| | |
|---|---|
| ***F04C 2/16*** | (2006.01) |
| ***F04D 13/08*** | (2006.01) |
| ***F04C 2/107*** | (2006.01) |
| ***F04D 13/10*** | (2006.01) |
| ***F04D 29/62*** | (2006.01) |
| ***F04D 29/64*** | (2006.01) |
| *E21B 23/01* | (2006.01) |
| *E21B 23/02* | (2006.01) |

(52) U.S. Cl.
CPC ..... *F04D 13/086* (2013.01); *F04D 13/10* (2013.01); *F04D 29/606* (2013.01); *F04D 29/628* (2013.01); *F04D 29/648* (2013.01); *E21B 23/01* (2013.01); *E21B 23/02* (2013.01); *F04C 2230/60* (2013.01); *Y10T 29/49236* (2015.01)

(58) Field of Classification Search
CPC ..... F04D 29/628; F04D 29/648; E21B 33/00; E21B 43/121; E21B 43/128; E21B 23/01; E21B 23/02; E21B 43/126; E21B 43/129
USPC ..... 417/360
See application file for complete search history.

(56) References Cited

U.S. PATENT DOCUMENTS

| | | | | |
|---|---|---|---|---|
| 4,948,348 | A | 8/1990 | Doll et al. | |
| 4,966,532 | A | 10/1990 | Fengsheng | |
| 5,611,397 | A * | 3/1997 | Wood | E21B 43/129 166/105 |
| 6,167,965 | B1 * | 1/2001 | Bearden | E21B 43/121 166/105.5 |
| 6,388,353 | B1 * | 5/2002 | Liu | F04B 13/00 310/114 |
| 6,595,295 | B1 | 7/2003 | Berry et al. | |
| 6,695,060 | B1 * | 2/2004 | Guidry, Jr. | E21B 23/02 166/105 |
| 7,287,584 | B2 * | 10/2007 | Angman | E21B 21/10 166/177.4 |
| 7,325,606 | B1 * | 2/2008 | Vail, III | E21B 43/128 166/250.15 |
| 7,407,040 | B2 * | 8/2008 | Doran | B66B 11/0438 187/250 |
| 7,874,368 | B2 * | 1/2011 | Blaquiere | E21B 43/126 166/370 |
| 2007/0074871 | A1 * | 4/2007 | Olson | E21B 43/121 166/369 |
| 2009/0142207 | A1 * | 6/2009 | Ring | F04B 47/06 417/410.1 |

FOREIGN PATENT DOCUMENTS

| | | |
|---|---|---|
| DE | 297 11 534 U1 | 10/1998 |
| DE | 298 15 163 U1 | 1/1999 |
| DE | 10 2004 013 380 A1 | 10/2005 |
| EP | 0 746 683 B1 | 9/1999 |

OTHER PUBLICATIONS

English-language translation of previously submitted document C2 (three (3) pages).
International Search Report dated Jul. 30, 2012 with English translation (five (5) pages).
German Office Action dated Jan. 4, 2012 (five (5) pages).

* cited by examiner

IMMERSION PUMP AND METHOD FOR ASSEMBLING AN IMMERSION PUMP

CROSS REFERENCE TO RELATED APPLICATIONS

This application is a national stage of PCT International Application No. PCT/EP2012/060096, filed May 30, 2012, which claims priority under 35 U.S.C. §119 from German Patent Application No. 10 2011 077 777.6, filed Jun. 17, 2011, the entire disclosures of which are herein expressly incorporated by reference.

BACKGROUND AND SUMMARY OF THE INVENTION

The invention relates to a submersible pump, and to a method for producing a submersible pump, comprising a casing, with a suction-side inlet opening, a pressure-side outlet opening and a through-passage for electric lines, and also comprising an electronics unit, an electric motor, a pressure chamber and a pump unit.

Submersible pumps are a generic type of pump designed for various areas of use and co-ordinated with requirements in each case. The essential factor is the possibility of submerging the pump into the fluid which is to be delivered. One specific embodiment requires that the pump can be placed in a borehole or well. Since boreholes or wells, in particular those which are very deep, are very costly, adaptation to the borehole or well is a significant feature of such a pump.

U.S. Pat. No. 4,966,532 discloses a submersible motor pump in which the inlet, pump and outlet are arranged axially in a row. Individual components are surrounded by a common shell which is subdivided into a first region, which encloses the motor, and a second region, which encloses the pump. The two regions are connected by a connecting element, which defines both the distance of the components from the inner wall of the casing and the axial position.

EP 0 746 683 B1 discloses a submersible pump of the generic type in which the essential individual components of the pump are arranged axially. The suction-side inlet cover, the pump impeller, the motor and the pressure-side outlet cover are located in a single line. These individual components are accommodated in a tubular shell, wherein the fluid delivered is guided to the pressure-side outlet opening through a gap between the motor and the casing. The gap between the tubular shell and the motor casing is defined by an elastomeric pads. The motor is installed on the suction-side inlet cover, which also contains the pump impeller. The pressure-side outlet cover is connected merely to the tubular shell.

It is an object of the invention to provide a submersible pump of the generic type which allows straightforward assembly and repair of the submersible pump.

The solution provides a submersible pump in which the electronics unit, the electric motor, the pressure chamber and the pump unit can be preassembled to form an insert, wherein the preassembled insert is supported at one end of the casing and an axial clamping and/or fastening system is provided at the opposite end of the casing. The electronics unit may comprise both power electronics and signal electronics.

The construction of the submersible pump according to the invention allows the preassembled individual components to be placed in position prior to being introduced into the surrounding casing. It is also possible for the surrounding casing to be configured in a single part or piece, and this improves the sealing against the ingress of fluid. The clamping and fastening system makes it possible to provide the insert with prestressing.

According to one configuration of the submersible pump according to the invention, the clamping and/or fastening system can be released. This has the advantage that the insert can be removed from the surrounding casing for inspection purposes. Thereafter, it can be re-inserted and fixed in the casing anew by the clamping and/or fastening system.

It is particularly advantageous to configure the clamping and/or fastening system as a taper lock clamping bushing, this making it possible to establish a force-fitting connection which is centered axially.

In a further advantageous configuration, all the components of the insert are provided with fixed or releasable devices for providing support, in particular radial support, against the casing. The devices serve for transporting heat from the motor to the surrounding casing and, at the same time, support the insert assembly on the casing at a precisely defined distance therefrom, wherein displacement of individual components during operation of the pump is prevented.

It is advantageous for a bearing for supporting the insert, in particular for supporting the same in a centered manner, to be provided in the region of the pressure-side outlet opening. The insert can be fitted directly into this bearing by means of a guide during assembly. The centering makes it easier to establish the defined prestressing of the insert in relation to the surrounding casing.

The motor is advantageously a synchronous motor, in particular a synchronous motor equipped with permanent magnets. These motors are energy-efficient, easy to operate and robust. If the submersible motor pump is used as a pump for drilling boreholes or wells, then it is imperative for the technology used to be robust, since the pump has to be raised out of the borehole or well for repair purposes.

In one configuration of the invention, the pump is configured as a centrifugal pump. It is advantageous here that large delivery volumes with a variable delivery height are possible. It is also possible, in the case of centrifugal pumps, to deliver small quantities of sand.

In a further embodiment, the pump is configured as a positive-displacement pump, in particular as an eccentric screw pump. This self-priming pump allows considerable delivery heights and variable delivery volumes along with low-pulsation operation.

In a further embodiment, a pressure line is provided on the pressure-side outlet opening, a retaining means for a traction mechanism of the submersible pump being integrated in said pressure line. In particular, the outlet opening itself can function as a retaining means. For inspection purposes, the pump can be raised out of the borehole or well by way of the traction mechanism. This simplifies the assembly of the pump on site, in particular in a borehole or well.

It is a further object of the invention to provide a method for producing a submersible pump of the construction described above.

The solution provides a method for producing and for assembling a submersible pump of the construction described above, wherein in a first step an insert is preassembled from an electronics unit, an electric motor, a pressure chamber and a pump unit, in a second step the insert is introduced into a casing, the insert being centered in the casing, and in a third step the insert is braced and fastened in the casing by a clamping and/or fastening system. The preassembly allows precise positioning of the individual components prior to the insert being introduced into the surrounding casing. If the insert is pushed into the surrounding casing, for example, on the suction side, then the devices for maintaining a fixed distance between the insert and the surrounding casing center the insert and the bearing on the pressure side and defines the precise position of the insert. The clamping system makes it possible for the insert to be subjected to prestressing. The fastening system secures the insert in the surrounding casing. If use is made of a taper lock fastening system, then the clamping assembly can be braced freely at the suction-side end of the surrounding tube without any further provision, for example holes or threads, having to be made there. The fastening of the insert can be released for inspection purposes. If the length of the insert should be changed slightly during the inspection, then the insert can be fastened in the surrounding casing again using the same fastening system.

Further configurations can be gathered from combining what has been presented thus far, and will therefore not be explained to any further extent here.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
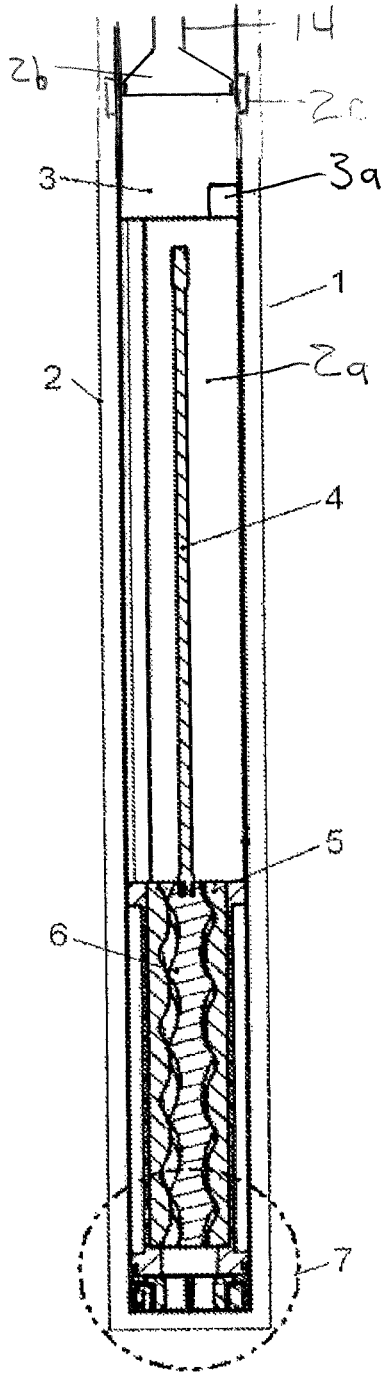
FIG. 1 shows a submersible pump according to an embodiment of the invention.

FIG. 1 shows a submersible motor pump 1 according to the invention. A casing 2 contains, as indicated at the upper end, a drive 3 and electronics unit 3*a*, which is connected to the actual pump element via a coupling element 4. The pump element, in the example illustrated, is designed as an eccentric screw pump, comprising a stator 5 and a rotor 6, which are constituted by a metal/elastomer pairing or a plastics/elastomer pairing. A detail, comprising the clamping system 7, is marked at the lower end of the submersible pump 1. The eccentric screw pump allows water to be delivered continuously, wherein the pump may be self-priming. The technology made up of the stator 5 and rotor 6 is very robust and can be used even in an abrasive, for example sandy, environment. The coupling element 4, which is configured as a long rod, passes through pressure chamber 2*a* and makes it possible to establish a connection between the eccentric rotor 5 and the drive 3. The drive 3 used is typically an electric motor. In order to achieve a high power density, use is made of a synchronous motor equipped with permanent magnets. This achieves small structural dimensioning, as a result of which the costs for a deep well hole can be reduced to a considerable extent. The fluid flowing from the pressure chamber 2*a* past the drive 3 and bearing 2*c* is received via pressure-side outlet opening 2*b* into pressure line 14.

The individual components of the submersible pump are introduced into the casing 2 from below. For assembly, in the first instance the drive 3 is placed in the casing 2, the drive 3 already having been connected to the rod, as coupling element 4, and to the rotor 5. The clamping system 7 according to the invention, in the form of a taper lock clamping system, is provided for secure, rotationally fixed fastening of the insert in the casing 2.

Figure 2:
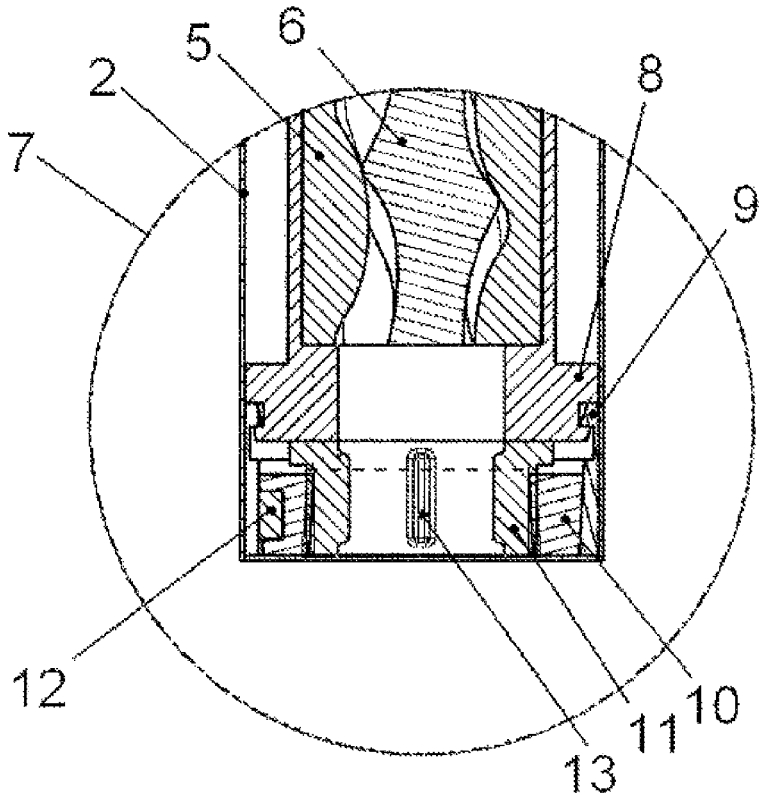
FIG. 2 shows a detail-form view from FIG. 1.

FIG. 2 shows the details of the axial clamping and/or fastening system of the submersible pump. A pressure-exerting piece 8 encloses the stator 5 and, at the lower end of the stator 5, provides a pressure-exerting surface for the rest of the components of the clamping system 7. This pressure-exerting piece 8 is followed directly by a snap-fitting element 9, the latter being fixedly connected to the pressure-exerting piece 8 by a latching function and being supported against the casing 2. A conical, inner clamping ring 10, which forms the taper bushing, is arranged in abutment against the snap-fitting element 9. Said inner clamping ring 10, which is provided with a thread, has arranged within it an outer clamping ring 11, which is likewise provided with a thread, this allowing it to be braced with the inner clamping ring 10. The two clamping rings are braced such that they are supported against the snap-fitting element 9, that is to say also against the casing 2. A feather key 12 is provided, in addition, to prevent rotation. For simplified installation of the clamping system, cutouts 13 are provided on the outer clamping ring 11, these allowing a suitable tool to be applied for bracing purposes. The embodiment with cutouts 13 makes it possible to provide a predefined, straightforward and cost-effective means for applying a tool, which considerably increases the functional reliability and ease of installation.

Figure 3:
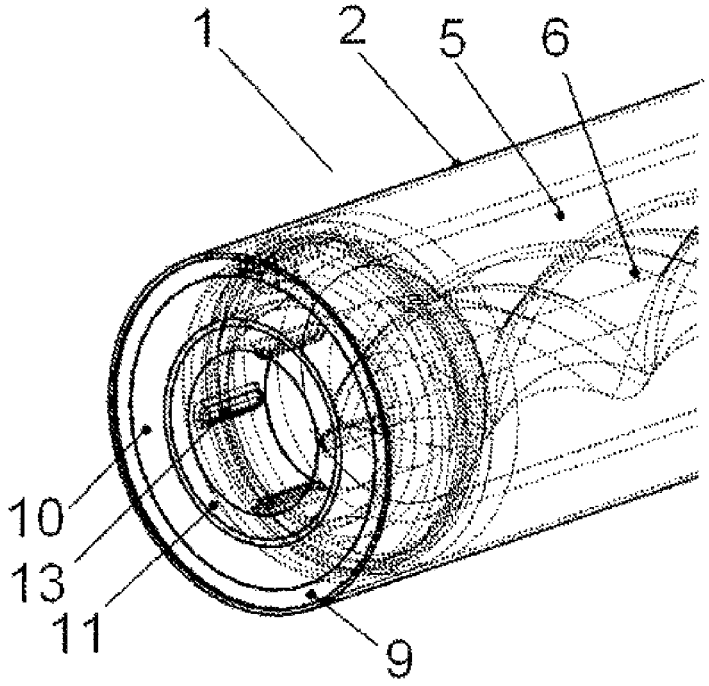
FIG. 3 shows an isometric illustration of the detail-form view of FIG. 2.

FIG. 3 shows an isometric illustration of the submersible pump 1, in particular the detail of the clamping system 7 from FIG. 1 being shown. In the right-hand part of the figure, the stator 5 and the rotor 6 is illustrated in the casing 2. The arrangement of the individual components of the axial clamping and/or fastening system is shown on the left-hand side of FIG. 3. The casing 2 is followed directly by the snap-fitting element 9. The latter is fixedly connected to the pressure-exerting piece 8. The conical inner clamping ring 10 and the outer clamping ring 11, which is, for example, screw-connected thereto, is illustrated within the pressure-exerting piece 8. The illustration depicts the locations for applying a tool for screwing the outer clamping ring 11 into the inner clamping ring 10, said rings being braced with one another as a result of the conical shape of the inner clamping ring 10, in which case they are supported radially against the casing 2.

As an alternative, the invention can also be used in a submersible pump of which the motor is accommodated in a separate casing.

LIST OF DESIGNATIONS

1 Submersible pump
2 Casing
3 Drive
4 Coupling element
5 Stator
6 Rotor
7 Clamping system
8 Pressure-exerting piece
9 Snap-fitting element
10 Inner clamping ring
11 Outer clamping ring
12 Feather key
13 Cutouts The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A submersible pump, comprising:

a casing having a suction-side inlet opening, a pressure-side outlet opening and a through-passage for electric lines;

an electronics unit;

an electric motor;

a pressure chamber;

a pump unit; and a securing assembly, wherein the electric motor is arranged to drive the pump unit, the electronics unit at least one of controls electric power for driving the electric motor and processes information signals, the electronics unit, the electric motor, the pressure chamber and the pump unit are configured for assembly into a preassembled insert configured to be introduced into the casing and supported at a first end of the casing, and the securing assembly is at least one of an axial clamping and fastening system configured to be located at a second end of the casing opposite the first end, and is arranged to secure and apply a prestress to the preassembled insert in the casing, the at least one of axial clamping and fastening system including a pressure-exerting piece, a snap-fitting element supported against the casing and connected to the pressure-exerting piece by latching, a conical inner clamping ring having a radially-inner surface with threads and a radially-outer surface abutting a radially-inner surface of the snap-fitting element, and an outer clamping ring arranged radially within the inner clamping ring and axially abutting the pressure-exerting piece, the outer clamping ring having outer surface threads engaged with the inner surface threads of the inner clamping ring.

2. The submersible pump as claimed in claim 1, wherein the securing assembly is releasable from the casing.

3. The submersible pump as claimed in claim 2, wherein that the securing assembly includes a taper lock clamping bushing.

4. The submersible pump as claimed in claim 1, wherein at least one of the electronics unit, the electric motor, the pressure chamber and the pump unit is provided with at least one device configured to provide radial support against the casing.

5. The submersible pump as claimed in claim 1, further comprising:

a bearing configured to support the insert centered in the casing, the bearing being provided in a region of the pressure-side outlet opening.

6. The submersible pump as claimed in claim 1, wherein the electric motor is a synchronous motor having permanent magnets.

7. The submersible pump as claimed in claim 1, wherein the pump unit is a centrifugal pump.

8. The submersible pump as claimed in claim 1, wherein the pump unit is a positive-displacement pump.

9. The submersible pump as claimed in claim 8, wherein the positive-displacement pump is an eccentric screw pump.

10. The submersible pump as claimed in claim 1, wherein a pressure line provided at the pressure-side outlet opening is configured to serve as a traction mechanism for retaining the submersible pump.

11. A method for assembling a submersible pump, the submersible pump comprising a casing having a suction-side inlet opening, a pressure-side outlet opening and a through-passage for electric lines; an electronics unit; an electric motor; a pressure chamber; a pump unit; and a securing assembly, wherein the electric motor is arranged to drive the pump unit, the electronics unit at least one of controls electric power for driving the electric motor and processes information signals, the electronics unit, the electric motor, the pressure chamber and the pump unit are configured for assembly into a preassembled insert configured to be introduced into the casing and supported at a first end of the casing, and the securing assembly is at least one of an axial clamping and fastening system configured to be located at a second end of the casing opposite the first end, and is arranged to secure and apply a prestress to the preassembled insert in the casing, the at least one of axial clamping and fastening system including a pressure-exerting piece, a snap-fitting element supported against the casing and connected to the pressure-exerting piece by latching, a conical inner clamping ring having a radially-inner surface with threads and a radially-outer surface abutting a radially-inner surface of the snap-fitting element, and an outer clamping ring arranged radially within the inner clamping ring and axially abutting the pressure-exerting piece, the outer clamping ring having outer surface threads engaged with the inner surface threads of the inner clamping ring, comprising the steps of:

inserting the preassembled insert into the casing; and securing the preassembled insert in the casing with the securing assembly to brace and fasten the preassembled insert in the casing.

12. The method for assembling the submersible pump as claimed in claim 11, wherein the preassembled insert is positioned centered in the casing.

* * * * *